US006306337B1

(12) United States Patent
Kraus et al.

(10) Patent No.: US 6,306,337 B1
(45) Date of Patent: Oct. 23, 2001

(54) NOSEPIECE FOR DIRECTING A CHARGE INTO A FURNACE

(75) Inventors: Richard B. Kraus, Barrington; David A. Dawson, Hainesville, both of IL (US)

(73) Assignee: General Kinematics Corporation, Barrington, IL (US)

( * ) Notice: Subject to any disclaimer, the term of this patent is extended or adjusted under 35 U.S.C. 154(b) by 0 days.

(21) Appl. No.: 09/507,817

(22) Filed: Feb. 22, 2000

(51) Int. Cl.[7] ..... C21B 7/16
(52) U.S. Cl. ..... 266/183; 266/216
(58) Field of Search ..... 193/2 R; 266/216, 266/900, 901, 183

(56) References Cited

U.S. PATENT DOCUMENTS 3,390,872 * 7/1968 Ciochetto ..... 266/901
4,023,784 * 5/1977 Wallace ..... 266/216
4,211,316 * 7/1980 Rymarchyk et al. ..... 193/2 R
4,690,638 * 9/1987 Nakagawa et al. ..... 266/901
5,238,484 * 8/1993 Pirklbauer et al. ..... 266/900

* cited by examiner

*Primary Examiner*—Scott Kastler
(74) *Attorney, Agent, or Firm*—Marshall, Gerstein & Borun

(57) ABSTRACT

A nosepiece for directing a charge into a crucible of a furnace. The nosepiece comprises a completely enclosed sleeve which more accurately directs the charge into the crucible. The sleeve has a distal portion that deflects the charge toward a center area of the crucible, thereby minimizing impact of the charge on the top edge of the crucible and its refractory liner. In addition, the nosepiece is split so that the distal portion is movable, thereby to provide access to an interior of the nosepiece. As a result, any bridging in the charge may be addressed by moving the distal portion to an open position.

17 Claims, 2 Drawing Sheets

NOSEPIECE FOR DIRECTING A CHARGE INTO A FURNACE

FIELD OF THE INVENTION

The present invention generally relates to foundry apparatus, and more particularly to apparatus for supplying a charge to a furnace.

BACKGROUND OF THE INVENTION

Foundries often include induction furnaces for melting metals. The induction furnace typically comprises an elongate, cylindrical crucible inside which the metal material is melted. The furnace must generate high temperatures, on the order of 2500 degrees Fahrenheit or more, to melt the metal, and therefore the inside of the crucible is typically lined with a refractory.

The metallic material which is added to the furnace is called a charge. The charge typically includes steel, pig iron, alloys, and returns. The returns typically make up 30 to 50 percent of the charge, and include previously formed members such as runners and gates used in molds. The various components of the charge material may be provided in a wide variety of shapes. The gates and runners of the returns, for example, are often provided in the form of the elongate shafts or bars. Other materials may be provided in generally spherical or arcuate shapes.

A transport device is typically used to deposit the charge into the crucible. A vibratory feeder, for example, typically has a hopper portion for receiving the returns, pig iron and other materials to be discharged into the crucible. The vibratory feeder advances the charge toward a front end of the feeder. A nosepiece located at the end of the vibratory feeder is positioned over the crucible and defines a chute for directing the charge into the crucible.

As the charge is transported toward the front end of the vibratory feeder, the returns and other components of the charge may shift and intertwine such that the charge bridges rather than drops through the chute to the crucible. Accordingly, conventional nosepieces typically have an open construction to allow access to the charge in case the charge bridges. It is common, for example, a conventional nosepiece to have a semi-circular chute. The open construction, however, does not limit the distance which the charge material travels away from the vibratory feeder as it is pushed over the chute. As a result, portions of the charge may impact a top edge of the crucible thereby damaging the crucible. The charge also may impact and damage the refractory liner of the crucible. The materials and labor required to replace a refractory liner often costs on the order of $10,000.00 or more. In addition, the furnace is not available for use during refractory replacement, which typically takes 3–5 days, resulting in a significant amount of down time for the furnace. Accordingly, there is a need for a nosepiece which accurately deposits a charge into a crucible without damaging the crucible.

SUMMARY OF THE INVENTION

In accordance with certain aspects of the present invention, transport apparatus for directing a metallic charge into a crucible of a furnace is provided. The transport apparatus comprises a hopper for receiving the metallic charge, the hopper having a front end and a rear end. A feeder is disposed along a bottom of the hopper and is operable to carry the charge toward the front end of the feeder. A nosepiece is attached to the front end of the feeder, the nosepiece having a transition section comprising a downwardly sloped bottom wall and a spout section comprising a sleeve. The sleeve defines an enclosed conduit having a proximal portion located nearer the transition section and an opposing distal portion, and the sleeve has an outside diameter sized smaller than a diameter of the crucible.

In accordance with additional aspects of the present invention, a nosepiece is provided for directing a metallic charge into a crucible of a furnace. The nosepiece is adapted for attachment to a transport apparatus having a hopper for receiving the metallic charge, the hopper having a front end and a rear end, and a feeder is disposed along a bottom of the hopper and operable to carry the charge toward the front end of the feeder. The nosepiece comprises a transition section adapted for attachment to the front end of the transport apparatus, the transition section including spaced first and second side walls, a top wall, and a downwardly sloped bottom wall. The nosepiece includes a spout section comprising a sleeve having a proximal portion and a distal portion, the proximal and distal portions of the sleeve defining an enclosed conduit, the sleeve having an outside diameter sized smaller than a diameter of the crucible.

In accordance with still further aspects of the present invention, a nosepiece is provided for directing a metallic charge into a crucible of a furnace. The nosepiece is adapted for attachment to a transport apparatus having a hopper for receiving the charge, the hopper having a front end and a rear end, and a feeder disposed along a bottom of the hopper and operable to carry the charge toward the front end of the feeder. The nosepiece comprises a transition section adapted for attachment to the front end of the transport apparatus, the transition section including spaced first and second side walls, a top wall, and a downwardly sloped bottom wall. The nosepiece also includes a spout section comprising a sleeve having a proximal portion fixed to the transition section and a distal portion pivotably hinged to the transition section. The distal portion is movable between a closed position, in which the distal portion engages the proximal portion to from an enclosed conduit, and an open position, in which the distal portion is spaced from the proximal portion. The sleeve, in the closed position, has an outside diameter sized smaller than a diameter of the crucible

DETAILED DESCRIPTION OF THE PREFERRED EMBODIMENTS

Figure 1:
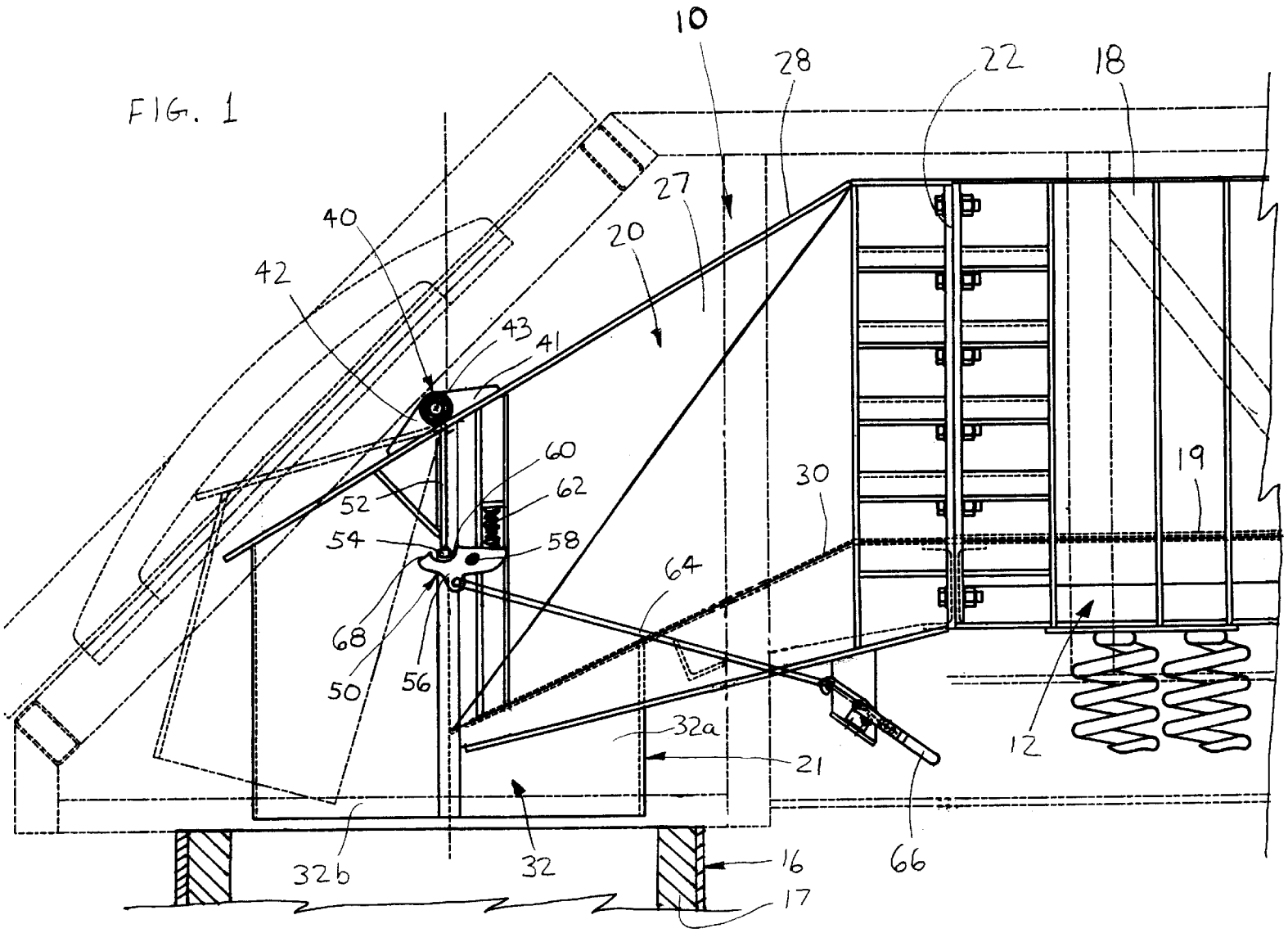
FIG. 1 is a side elevation view of a nosepiece in accordance with the present invention.
Figure 2:
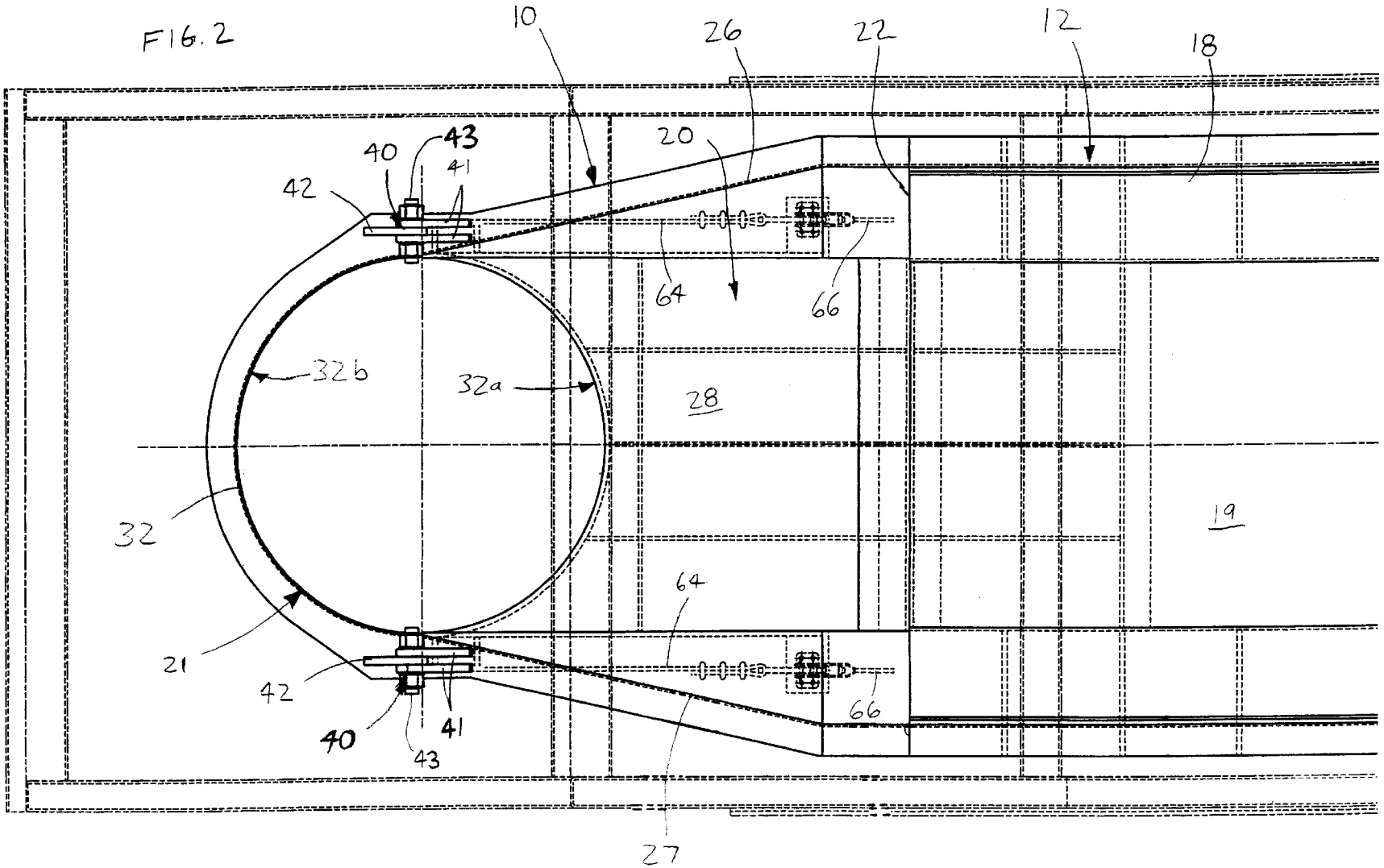
FIG. 2 is a plan view of the nosepiece in accordance with the present invention.

Referring to FIGS. 1 and 2, a nosepiece in accordance with the present invention is indicated generally with reference numeral 10. The nosepiece 10 is shown attached to a transport apparatus 12 adapted for receiving a charge and transporting the charge to the nosepiece 10. The nosepiece 10 directs the charge into a crucible 16 of a furnace having a refractory liner 17 (FIG. 1). While, for clarity of illustration, the nosepiece 10 is shown in FIGS. 1 and 2 as incorporated in a specific type of transport apparatus 12, persons of ordinary skill in the art will readily appreciate that the teachings of the invention are no way limited to that apparatus, or to any other particular environment of use. On the contrary, a nosepiece 10 in accordance with the teachings of the present invention may be used with any type of transport apparatus which would benefit from the advantages the nosepiece offers without departing from the scope or spirit of the invention.

As illustrated in FIGS. 1 and 2, the transport apparatus 12 includes a hopper 18 for receiving the charge. The charge may comprise a variety of materials such as steel, pig iron, alloys, and returns. The various charge materials are lifted, such as by a suspended magnet (not shown), positioned over the hopper 18, and deposited into the hopper 18. The transport apparatus includes a feeder, such as a vibratory feeder floor 19, for advancing the charge from the hopper 18 to a front end 22 of the transport apparatus 12.

The nosepiece 10 is attached to the front end 22 of the transport apparatus 12. The nosepiece 10 comprises a sloped transition section 20 which leads to a spout section 21 for directing the charge into the crucible 16. The transition section 20 includes first and second side walls 26, 27, top wall 28, and bottom wall 30 which slopes generally downward from the transport apparatus 12 to the spout section 21. The spout section 21 comprises a sleeve 32 which intersects and depends from the bottom wall 30. An outer surface of the sleeve 32 is shaped and sized for insertion into the crucible 16 of the furnace.

As best shown in FIG. 2, the sleeve 32 has a proximal portion 32*a* located nearest the transport apparatus 12 and a distal portion 32*b* located opposite the transport apparatus 12. In the preferred embodiment, the crucible 16 is cylindrical and has an inside diameter, and the outer surface of the sleeve 32 is also cylindrical and has an outside diameter slightly smaller than the inside diameter of the crucible. As a result, the lower end of the sleeve 32 may be located slightly above the crucible 16, to provide an enclosed conduit for transporting the charge from the transition section 21 to the crucible 16.

In operation, the charge is deposited into the hopper 18 of the transport apparatus. The vibratory feeder 20 advances the charge toward the front end 22 of the transport apparatus 12. The sloped bottom wall 30 of the transition section 20 advances the charge toward the spout section 21. The sleeve 32 directs the charge into the crucible 16 under the force of gravity. Accordingly, it will be appreciated that the sleeve 32 provides a completely enclosed conduit for directing the charge generally toward a center of the crucible to minimize contact with, and resulting damage to, the refractory liner 17 of the crucible 16. More specifically, the distal portion 32*b* of the sleeve 32 deflects the charge generally downward and toward a center of the sleeve 32 so that the charge material does not impact a top edge of the crucible 16 or its refractory liner 17.

In accordance with additional aspects of the present invention, the distal portion 32*b* of the sleeve 32 is moveable to allow access into the interior of the nosepiece 10. As best shown in FIGS. 1 and 2, the distal portion 32*b* of the sleeve 32 is attached by a pair of hinges 40 to the transition section of the nosepiece 10. According to the illustrated embodiment, the proximal portion 32*a* of the sleeve 32 is fixedly attached to the transition section 20. Each of the hinges 40 has a stationary member 41 attached to the transition section 20 near an associated side wall 26, 27 and a pivoting member 42 attached to opposite sides of the distal portion 32*b*. The pivoting members 42 pivot about a pivot hinge 43, which allows the distal portion 32*b* to swing upwardly to allow access to an interior of the nosepiece 10 near the spout section 21.

The movable distal portion 32*b* is particularly useful in situations where the charge bridges over the sleeve 32. If bridging occurs, the distal portion 32*b* may be moved to an open position, as drawn in phantom in FIG. 1, to remove the bridging portions of the charge. The outer profile of the distal portion 32*b* is shaped and sized to allow the distal portion 32*b* to pivot toward the open position even when the furnace has a fume hood 45 (illustrated in phantom). Subsequently, the distal portion 32*b* may be closed to once again form a complete spout, thereby precisely directing the charge into the crucible 16 as described above.

The nosepiece preferably includes a pair of spring-loaded latches 50 positioned near opposing side walls 26, 27 for selectively releasing the distal portion 32*b* for pivoting to the open position. As best shown in FIG. 1, the distal portion 32*b* includes a pair of vertical supports 52 having a horizontally aligned rod 54 attached to a bottom end. A latch body 56 is pivotably secured to the transition section at a pivot point 58, and defines a notch 60 sized to receive a corresponding rod 54. A spring 62 is positioned to engage an upper surface of the latch body 56. A link 64 has one end attached to a bottom surface of the latch body 56 at an opposite side of the pivot point 58 from the spring 62. A second end of the link 64 is attached to a handle 66 which actuates the link 64.

In a normal position, the spring 62 biases the latch body 56 to pivot so that the notch 60 engages the rod 54, thereby securing the distal portion 32*b* in the closed position. When the handle 66 is rotated, the link 64 pivots the latch body 56 against the force of the spring 62, thereby disengaging the notch 60 from the rod 54. The distal portion 32*b* may then be rotated to the open position. The latch body 56 further preferably includes a cam surface 68 which directs the rod 54 into the notch 60 as the distal portion 32*b* returns to the closed position.

In view of the foregoing, it will be appreciated that the present invention brings to the art a new and improved nosepiece for directing a charge into a crucible of a furnace. The nosepiece comprises a completely enclosed sleeve which more accurately directs the charge into the crucible. The sleeve has a distal portion that deflects the charge toward a center area of the crucible, thereby minimizing impact of the charge on the top edge of the crucible and its refractory liner. In addition, the nosepiece is split so that the distal portion is movable, thereby to provide access to an interior of the nosepiece. As a result, any bridging in the charge may be addressed by moving the distal portion to an open position.

The foregoing detailed description has been given for clearness of understanding only, and no unnecessary limitations should be understood therefrom, as modifications would be obvious to those skilled in the art.

What is claimed is:

1. A nosepiece for directing a metallic charge into a crucible of a furnace, the nosepiece adapted for attachment to a transport apparatus having a hopper for receiving the charge, the hopper having a front end and a rear end, and a feeder disposed along a bottom of the hopper and operable to carry the charge toward the front end of the feeder, the nosepiece comprising:

a spout section having a first sleeve portion secured in fixed relation to the transition section and a second sleeve portion pivotably hinged to the transition section, wherein the second sleeve portion is movable with respect to the first sleeve portion and transition section between a closed position, in which the second sleeve portion engages the first sleeve portion to form an enclosed conduit, and an open position, in which the a bottom edge of the second sleeve portion is spaced from the first sleeve portion to allow access into an interior of the spout section.

2. The nosepiece of claim 1, further comprising a spring-loaded latch adapted to engage and secure the second sleeve portion in the closed position, the spring-loaded latch being releasable to disengage from the portion, thereby allowing the second sleeve portion to move to the open position.

3. The nosepiece of claim 1, in which the furnace includes a fume hood extending over the crucible, and in which the nosepiece is sized to fit inside the fume hood.

4. The nosepiece of claim 3, in which the second sleeve portion has an outside profile shaped and sized to allow the second sleeve portion to pivot to the open position inside the fume hood.

5. The nosepiece of claim 1, in which the metallic charge comprises returns, and in which the transition section and spout section are sized to allow the returns to pass therethrough.

6. Transport apparatus for directing a metallic charge into a crucible of a furnace, the transport apparatus comprising:

a hopper for receiving the metallic charge, the hopper having a front end and a rear end;

a feeder disposed along a bottom of the hopper and operable to carry the charge toward the front end of the feeder; and a nosepiece attached to the front end of the feeder, the nosepiece including a transition section having a downwardly sloped bottom wall and a spout section having a first sleeve portion secured in fixed relation to the transition section and a second sleeve portion pivotably hinged to the transition section, wherein the second sleeve portion is movable with respect to the first sleeve portion and transition section between a closed position, in which the second sleeve portion engages the first sleeve portion to form an enclosed conduit, and an open position, in which a bottom edge of the second sleeve portion is spaced from the first sleeve portion to allow access into an interior of the spout section.

7. The transport apparatus of claim 6, further comprising a spring-loaded latch adapted to engage and secure the second sleeve portion in the closed position, the spring-loaded latch being releasable to disengage from the second sleeve portion, thereby allowing the second sleeve portion to move to the open position.

8. The transport apparatus of claim 6, in which the furnace includes a fume hood extending over the crucible, and in which the nosepiece is sized to fit inside the fume hood.

9. The transport apparatus of claim 8, in which the second sleeve portion has an outside profile shaped and sized to allow the second sleeve portion to pivot to the open position inside the fume hood.

10. The transport apparatus of claim 6, in which the metallic charge comprises returns, and in which the transition section and the spout section are sized to allow the returns to pass therethrough.

11. A nosepiece for directing a metallic charge into a crucible of a furnace, the nosepiece adapted for attachment to a transport apparatus having a hopper for receiving the charge, the hopper having a front end and a rear end, and a feeder disposed along a bottom of the hopper and operable to carry the charge toward the front end of the feeder, the nosepiece comprising:

a transition section adapted for attachment to the front end of the transport apparatus, the transition section including spaced first and second side walls, a top wall, and a downwardly sloped bottom wall; and a spout section having a first sleeve portion secured in fixed relation to the transition section and a second sleeve portion supported for pivotable movement with respect to the first sleeve portion and the transition section between a closed position, in which the second sleeve portion engages the first sleeve portion to form an enclosed conduit, and an open position, in which a bottom edge of the second sleeve portion is spaced from the first sleeve portion to allow access into an interior of the spout section.

12. The nosepiece of claim 11, further comprising a spring-loaded latch adapted to engage and secure the second sleeve portion in the closed position, the spring-loaded latch being releasable to disengage from the second sleeve portion, thereby allowing the second sleeve portion to move to the open position.

13. The nosepiece of claim 11, which the furnace includes a fume hood extending over the crucible, and in which the nosepiece is sized to fit inside the fume hood.

14. The nosepiece of claim 13, in which the distal portion has an outside profile shaped and sized to allow the second sleeve portion to pivot to the open position inside the fume hood.

15. The nosepiece of claim 11, in which the metallic charge comprises returns, and in which the transition section and spout section are sized to allow the returns to pass therethrough.

16. The nosepiece of claim 11, in which the second sleeve portion is pivotably hinged to the transition section.

17. The nosepiece of claim 11, in which the sleeve section has an outside diameter sized smaller than a diameter of the crucible.

* * * * *

UNITED STATES PATENT AND TRADEMARK OFFICE

CERTIFICATE OF CORRECTION

PATENT NO. : 6,306,337 B1
DATED : October 23, 2001
INVENTOR(S) : Kraus et al.

It is certified that error appears in the above-identified patent and that said Letters Patent is hereby corrected as shown below:

Column 4,
Line 59, After "comprising:" should be added -- a transition section adapted for attachment to the front end of the transport apparatus, the transition section including spaced first and second side walls, a top wall, and a downwardly sloped bottom wall; and --.

Signed and Sealed this

Sixteenth Day of July, 2002

*Attest:*

*Attesting Officer*

JAMES E. ROGAN
*Director of the United States Patent and Trademark Office*